US008640996B2

(12) United States Patent
Luetzow

(10) Patent No.: US 8,640,996 B2
(45) **Date of Patent: *Feb. 4, 2014**

(54) MULTIPLE DIRECTION RAILROAD GATE RELEASE MECHANISM

(75) Inventor: Edwin J. Luetzow, Brookings, SD (US)

(73) Assignee: MTR, Inc., Brookings, SD (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/569,514

(22) Filed: Aug. 8, 2012

(65) Prior Publication Data

US 2013/0031839 A1 Feb. 7, 2013

Related U.S. Application Data

(63) Continuation of application No. 12/001,104, filed on Dec. 10, 2007, now Pat. No. 8,240,618.

(51) Int. Cl.
*B61L 23/00* (2006.01)
*E01F 13/00* (2006.01)

(52) U.S. Cl.
USPC ..... 246/111; 49/9

(58) Field of Classification Search
USPC ..... 246/111–113, 114 A, 473 R, 473.1, 477; 49/9, 49, 141
See application file for complete search history.

(56) References Cited

U.S. PATENT DOCUMENTS

| | | | | |
|---|---|---|---|---|
| 4,219,969 | A | 9/1980 | Reinitz et al. | |
| 4,897,960 | A | 2/1990 | Barvinek et al. | |
| 5,442,878 | A | 8/1995 | Flores | |
| 5,992,800 | A | 11/1999 | Sass | |
| 6,327,818 | B1 | 12/2001 | Pease | |
| 6,470,626 | B2 | 10/2002 | Luetzow | |
| 6,672,008 | B1 | 1/2004 | Luetzow | |
| 6,966,146 | B2 | 11/2005 | Pease | |
| 8,240,618 | B1 * | 8/2012 | Luetzow | 246/111 |
| 8,485,478 | B2 | 7/2013 | Luetzow et al. | |
| 2011/0113690 | A1 | 5/2011 | Luetzow et al. | |

OTHER PUBLICATIONS

U.S. Appl. No. 12/001,104, filed Dec. 10, 2007, Multiple Directional Railroad Gate Release Mechanism.
U.S. Appl. No. 12/944,627, filed Nov. 11, 2010, System and Method for Servicing a Breakaway Gate.
"U.S. Appl. No. 12/001,104, Decision on Pre-Appeal Brief mailed May 4, 2011", 2 pgs.
"U.S. Appl. No. 12/001,104, Final Office Action mailed Dec. 9, 2010", 8 pgs.

(Continued)

*Primary Examiner* — R. J. McCarry, Jr.
(74) *Attorney, Agent, or Firm* — Schwegman Lundberg & Woessner, P.A.

(57) ABSTRACT

An example includes an apparatus for releasing a railroad gate in at least two directions. The example includes a primary pivot member and a secondary pivot member pivotally connected to the primary pivot member, with one end of the railroad crossing connectable to the secondary pivot member. In the example the primary pivot member is rotable around a primary pivot of the apparatus, the primary pivot member rotable in a first direction against a first spring bias and in a second direction, opposite the first direction, against a second spring bias other than the first spring bias, and wherein the secondary pivot member is rotable around a secondary pivot of the apparatus, the secondary pivot member rotable in the first direction against a third spring bias other than the first spring bias and the second spring bias.

20 Claims, 11 Drawing Sheets

(56) References Cited

OTHER PUBLICATIONS

"U.S. Appl. No. 12/001,104, Non-Final Office Action mailed May 25, 2010", 7 pgs.
"U.S. Appl. No. 12/001,104, Notice of Allowance mailed Apr. 9, 2012", 5 pgs.
"U.S. Appl. No. 12/001,104, Pre-Appeal Brief Request filed Apr. 11, 2011", 5 pgs.
"U.S. Appl. No. 12/001,104, Response filed Sep. 21, 2010 to Non Final Office Action mailed May 25, 2010", 12 pgs.
"U.S. Appl. No. 12/001,104, Response filed Oct. 10, 2011 to Final Office Action mailed Dec. 9, 2010", 12 pgs.
"U.S. Appl. No. 12/944,627, Non Final Office Action mailed Sep. 6, 2012", 6 pgs.
"U.S. Appl. No. 12/944,627, Response filed Jan. 7, 2013 to Non Final Office Action mailed Sep. 6, 2012", 9 pgs.
"U.S. Appl. No. 12/944,627, Notice of Allowance mailed Mar. 18, 2013", 5 pgs.

* cited by examiner

MULTIPLE DIRECTION RAILROAD GATE RELEASE MECHANISM

CROSS REFERENCES TO RELATED APPLICATIONS

This application is a continuation of U.S. application Ser. No. 12/001,104, filed Dec. 10, 2007, to grant as U.S. Pat. No. 8,240,618; and is related to U.S. application Ser. No. 12/944,627, filed Nov. 11, 2010, which is a continuation-in-part of U.S. application Ser. No. 12/001,104, the specifications of each of which are incorporated herein by reference in their entirety.

BACKGROUND OF THE INVENTION

1. Field of the Invention

The present invention is for a railroad gate release mechanism, and in particular, for a multiple direction railroad gate release mechanism which allows for maintaining the structural integrity of a railroad grade crossing arm when struck from one or more directions by an automotive vehicle. Although a multiple direction railroad gate release mechanism is described, the release mechanism can be used for other gates such as, but not limited to, parking lot gates, restricted access gates, road closure gates, toll gates, crowd control gates and the like.

2. Description of the Prior Art

Railroad crossing grades are protected by railroad grade crossing arms which are stored substantially in a vertical position and which are actuated by railroad gate actuators. The actuators reorient the crossing arms to a horizontal position across a railroad crossing grade. The crossing arms warn operators of vehicles of oncoming train traffic and physically place a barrier in the form of a crossing arm at both sides of the railroad crossing grade to discourage and prevent the passage of a vehicle into the railroad crossing grade. Motorists unaware of the movement of a crossing arm may impinge either the front or the back of the crossing arm to the extent that physical damage may occur whereby the crossing arm is broken or parted from the railroad gate actuator. In some situations, the motorist may physically damage a first crossing arm or may avoidingly maneuver the motor vehicle around the end of the first crossing arm whereby damaging impact with a second opposed crossing can result. Such an occurrence can compromise the safety of the railroad grade crossing in that other motorists will not be warned of impending danger due to the destruction of one or more of the crossing arms. Such occurrences will compromise safety as well as add a financial maintenance burden.

SUMMARY OF THE INVENTION

The general purpose of the present invention is to provide a multiple direction railroad gate release mechanism.

According to one embodiment of the present invention, there is provided a multiple direction railroad gate release mechanism for attachment between a railroad gate actuator and a crossing arm. The mechanism includes opposing channel shaped brackets which attach to the railroad gate actuator and which also serve as a mounting structure for other components. Reference is made to the multiple direction railroad gate release mechanism as deployed in a horizontal situation across a railroad crossing grade. A primary pivot arm assembly to which a secondary pivot arm assembly and a crossing arm are attached, pivotally mounts between vertically opposed top and bottom bearing support plates located on the inwardly facing surfaces of opposed channel shaped brackets. The primary pivot arm assembly is pivotable for the most part in a clockwise direction or to a lesser extent in a counterclockwise direction from a centered detent neutral position until limited by contacting limit stops. For example and illustration, the primary pivot arm assembly is pivotable 45° clockwise about a pivot pin and is pivotable 15° counterclockwise about the pivot pin. The primary pivot arm assembly is influenced by a detent and plunger arrangement which maintains a combined perpendicular relationship of the primary pivot arm assembly, the secondary pivot arm assembly and the attached crossing arm with respect to the railroad gate actuator until acted upon by outside forces. Most commonly, an outside force impinges one or more of the crossing arms when the crossing arms are deployed horizontally across both sides of a crossing grade, such as a vehicle impinging the front (approach) side of one of the crossing arms from a roadway. Such front side impingement causes the multiple direction railroad gate release mechanism, with the attached secondary pivot arm assembly and crossing arm, to pivotally overcome the influence of the detent and plunger arrangement and to swing horizontally out of the way of the oncoming impinging vehicle. Impingement from the front side of the crossing arm from a roadway can occur without functional damage to the crossing arm. Such pivotal yielding substantially reduces the possibility of breakage of the crossing arm, as little bending moment is actually applied along the crossing arm itself due to the substantially unrestricted repositioning yielding movement allowed by the multiple direction railroad gate release mechanism. Subsequent to such impingement and when the vehicle has ceased to contact the crossing arm, top and bottom spring assemblies function to return the primary pivot arm assembly of the multiple direction railroad gate release mechanism with the attached secondary pivot arm assembly and crossing arm to the detent and neutral centered position to continue to offer gated protection at the railroad crossing grade, especially for those vehicles approaching from the abutting roadway. A shock absorber allows for rapid rate pivoting of the primary pivot arm assembly and attached secondary pivot arm assembly and attached crossing arm in one direction during impingement and allows for a slower rate return of the primary pivot arm assembly and attached members in the return direction subsequent to impingement. The centering spring assembly assists in returning of the primary pivot arm assembly to the detent position in the case of a return overshoot.

Additional protection of the crossing arm is afforded in the opposite direction with respect to a vehicle on the actual crossing grade, i.e., a vehicle on the tracks which approaches and impinges the back side of the crossing arm. The secondary pivot arm assembly is pivotally mounted to the primary pivot arm assembly and extends outwardly therefrom to accommodate attachment of the crossing arm to offer relief from a crossing arm back side impingement. The secondary pivot arm assembly pivots in a counterclockwise direction about a pivot pin located near the end of the primary pivot arm assembly. Top and bottom spring assemblies function to return the secondary pivot arm assembly and maintain the combined perpendicular relationship of the primary pivot arm assembly, the secondary pivot arm assembly, and the attached crossing arm with respect to the railroad gate actuator.

One significant aspect and feature of the present invention is a multiple direction railroad gate release mechanism which is secured between the mount arms of a railroad gate actuator and a crossing arm.

Another significant aspect and feature of the present invention is a multiple direction railroad gate release mechanism which, when impinged, releasably allows a breakaway positioning in two directions of a crossing arm from a normal and detent position in order to prevent damage to the crossing arm.

Another significant aspect and feature of the present invention is a multiple direction railroad gate release mechanism which allows the return positioning of a crossing arm to a normal and detent position subsequent to a breakaway positioning caused by impingement.

Still another significant aspect and feature of the present invention is a multiple direction railroad gate release mechanism which offers grade crossing protection subsequent to crossing arm impingement.

Still another significant aspect and feature of the present invention is a multiple direction railroad gate release mechanism having a secondary pivot arm assembly pivotally attached to a primary pivot arm assembly where the secondary pivot arm assembly can operate in concert with the primary pivot arm assembly or can operate independently of the primary pivot arm assembly.

Yet another significant aspect and feature of the present invention is the use of cables attached to the primary pivot arm assembly which are influenced by springs in spring assemblies which springs are compressed during impingement with the front side of a crossing arm and which are used to subsequently power the return of the primary pivot arm assembly, attached secondary pivot arm assembly and attached crossing arm assembly to an original neutral and detent position.

A further significant aspect and feature of the present invention is the use of a shock absorber which allows rapid deployment of the primary pivot arm assembly having an attached secondary pivot assembly and attached crossing arm during frontal crossing arm impingement and which allows return of the primary pivot arm assembly having the attached secondary pivot arm assembly and crossing arm at a slower rate subsequent to impingement, whereby the slower return rate reduces the possibility of a return overshoot of the primary pivot arm assembly, attached secondary pivot arm assembly and attached crossing arm assembly.

Yet another significant aspect and feature of the present invention is the use of swing stops which limit the travel of the primary pivot arm assembly in clockwise and counterclockwise rotational movements in order to prevent overstressing or other damage to the cables used in the associated spring assemblies.

Yet another significant aspect and feature of the present invention is the use of stop plates or other structure which limit the travel of the secondary pivot arm assembly in a counterclockwise rotational movement in order to prevent overstressing or other damage to the cables used in the associated spring assemblies.

A still further significant aspect and feature of the present invention is the use of a centering spring assembly which urges the primary pivot arm assembly into a normal and detent position when a returning primary crossing arm assembly, attached secondary pivot arm assembly, and attached crossing arm assembly overshoot a neutral detent position.

Having thus described an embodiment of the present invention and having set forth significant aspects and features thereof, it is the principal object of the present invention to provide a multiple direction railroad gate release mechanism.

BRIEF DESCRIPTION OF THE DRAWINGS

Other objects of the present invention and many of the attendant advantages of the present invention will be readily appreciated as the same becomes better understood by reference to the following detailed description when considered in connection with the accompanying drawings, in which like reference numerals designate like parts throughout the figures thereof and wherein.

DETAILED DESCRIPTION OF THE PREFERRED EMBODIMENTS

Figure 1:
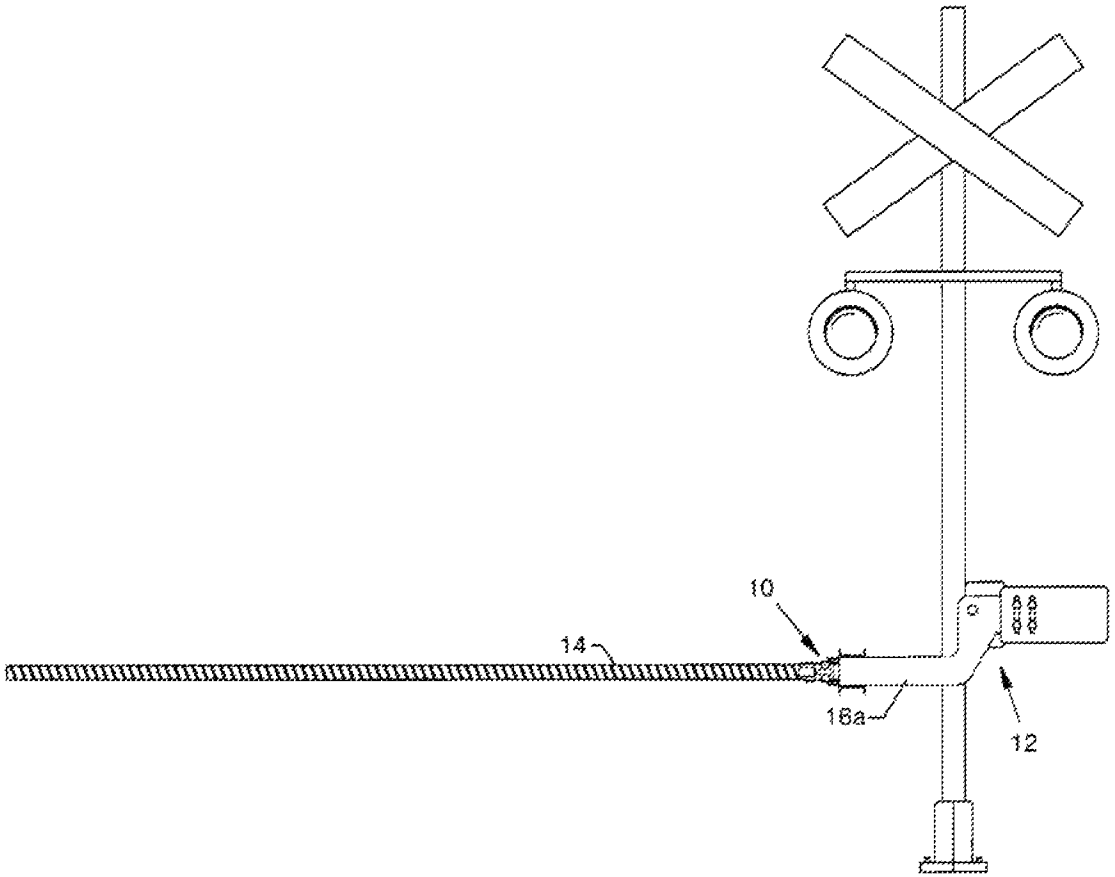
FIG. 1 illustrates the use of a multiple direction railroad gate release mechanism, the present invention, wherein a railroad gate actuator is shown in the actuated position to position the multiple direction railroad gate release mechanism and the attached crossing arm in a horizontal position.

FIG. 1 shows the use of the multiple direction railroad gate release mechanism 10 of the present invention. A railroad gate actuator 12 is shown in the actuated position to position the multiple direction railroad gate release mechanism 10 and attached crossing arm 14 in a horizontal position. The multiple direction railroad gate release mechanism 10 is mounted between the ends of the mount arms 16*a* and 16*b* (FIG. 2) and the crossing arm 14 is mounted to the multiple direction railroad gate release mechanism 10.

Figure 2:
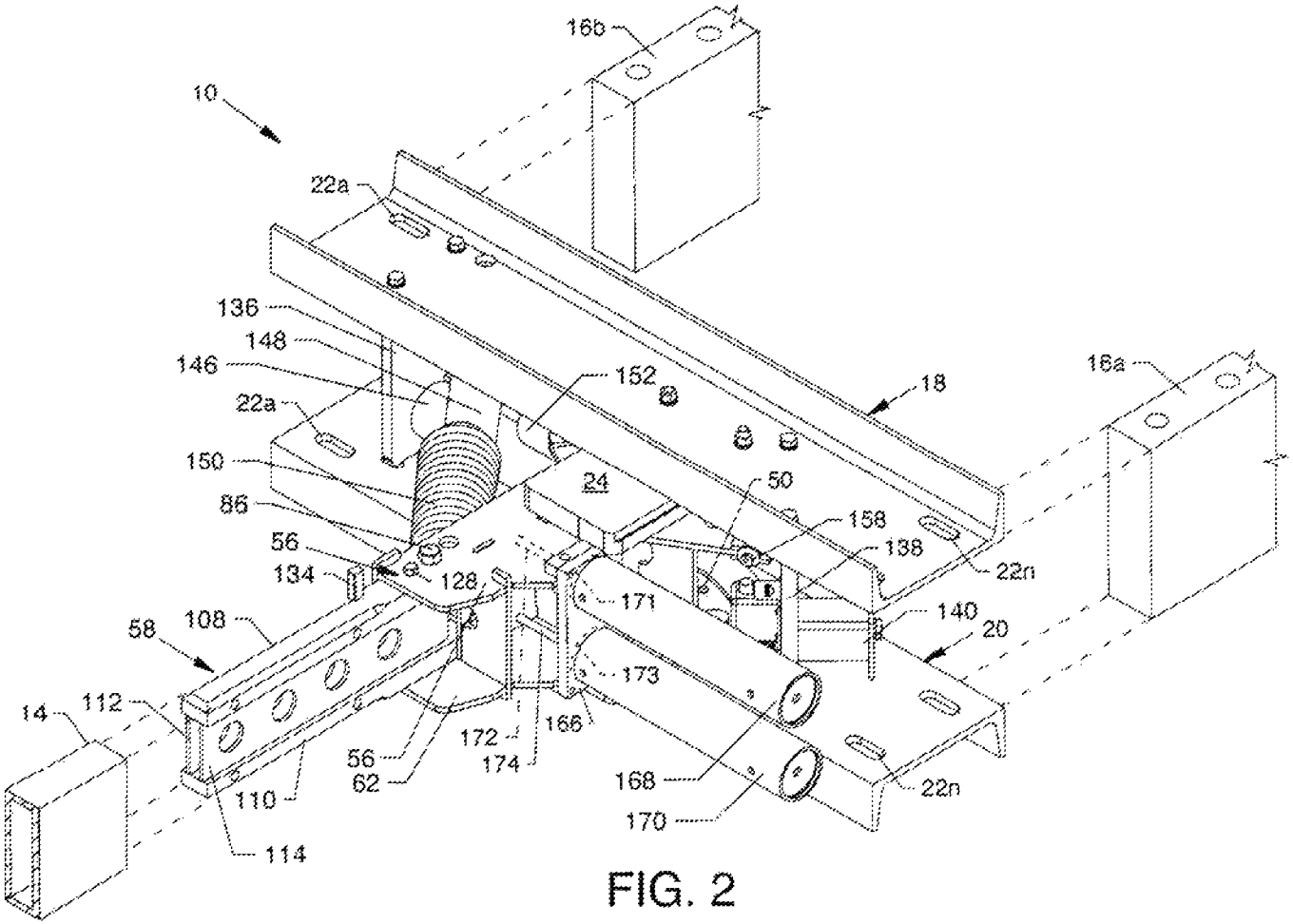
FIG. 2 is a right side isometric view of the multiple direction railroad gate release mechanism, the present invention, along with portions of mount arms and a crossing arm which are associated therewith in use.

FIG. 2 is a right side isometric view of the multiple direction railroad gate release mechanism 10 of the present invention showing its connecting relationship between mount arms 16*a* and 16*b* of the railroad gate actuator 12 and the crossing arm 14. Top and bottom mounting brackets 18 and 20 in the form of channels accommodate attachment of the mount arms 16*a* and 16*b*. The crossing arm 14 is secured over and about a secondary pivot arm assembly 58 of the multiple direction railroad gate release mechanism 10, each of which is shown in a horizontal position, such as for stopping traffic at a railroad grade crossing.

Figure 3:
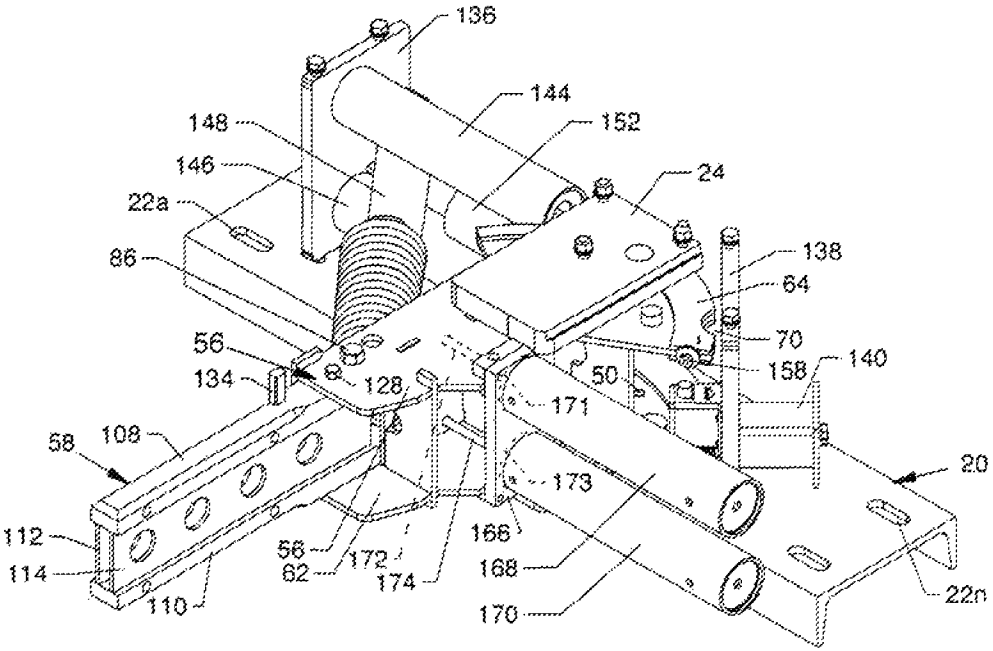
FIG. 3 is a right side isometric view of the multiple direction railroad gate release mechanism with a top bracket removed.
Figure 4:
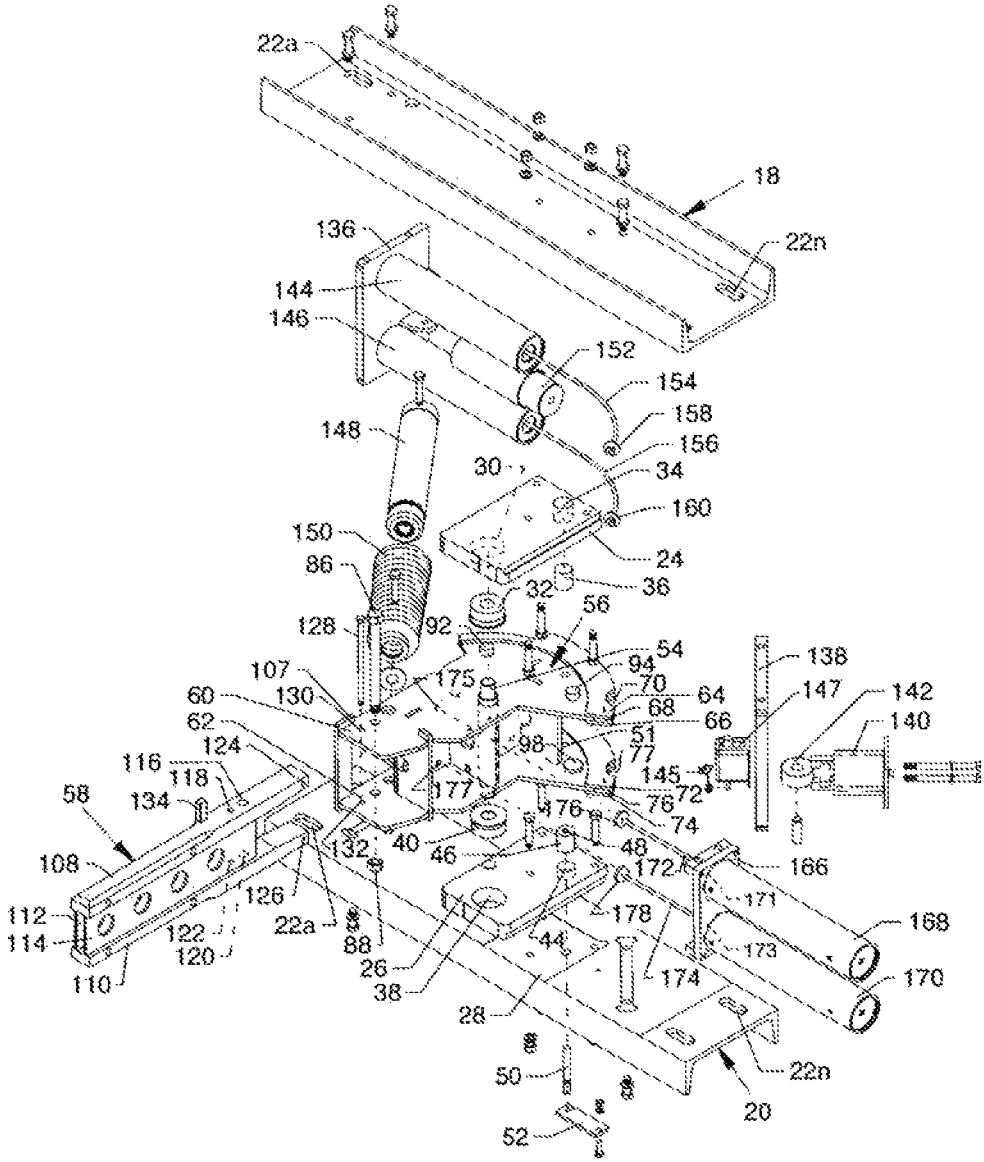
FIG. 4 is an exploded isometric view of the components of the invention shown in FIG. 2.
Figure 5:
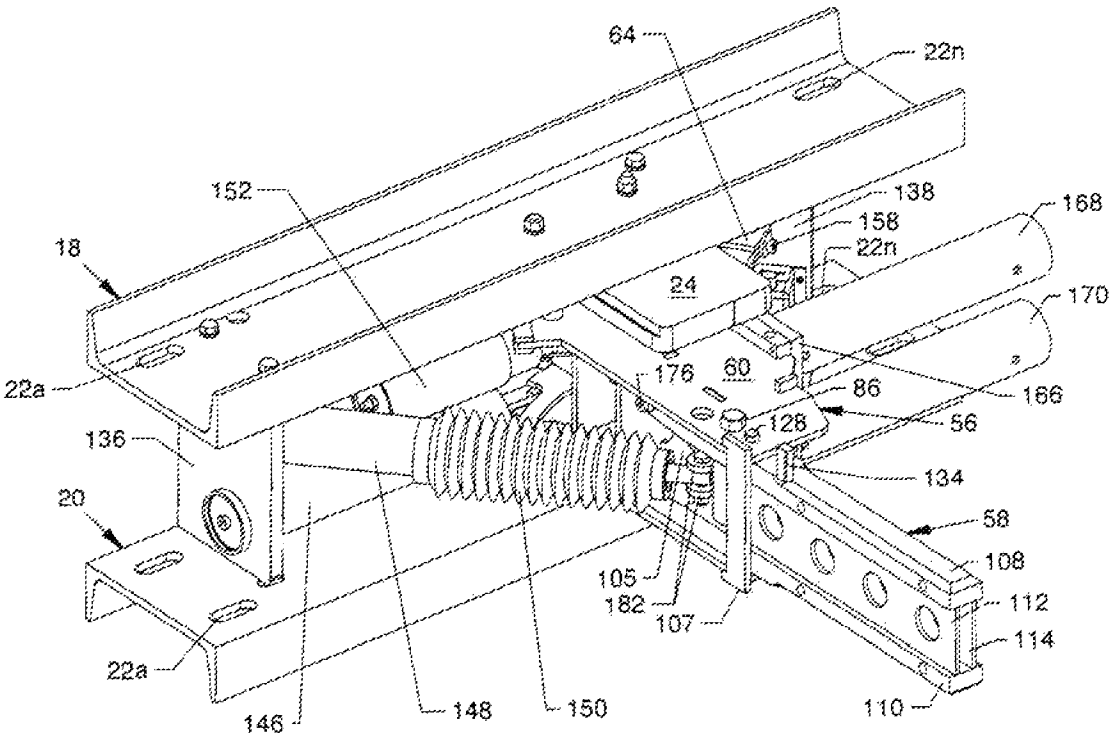
FIG. 5 is left side isometric view of the multiple direction railroad gate release mechanism.
Figure 6:
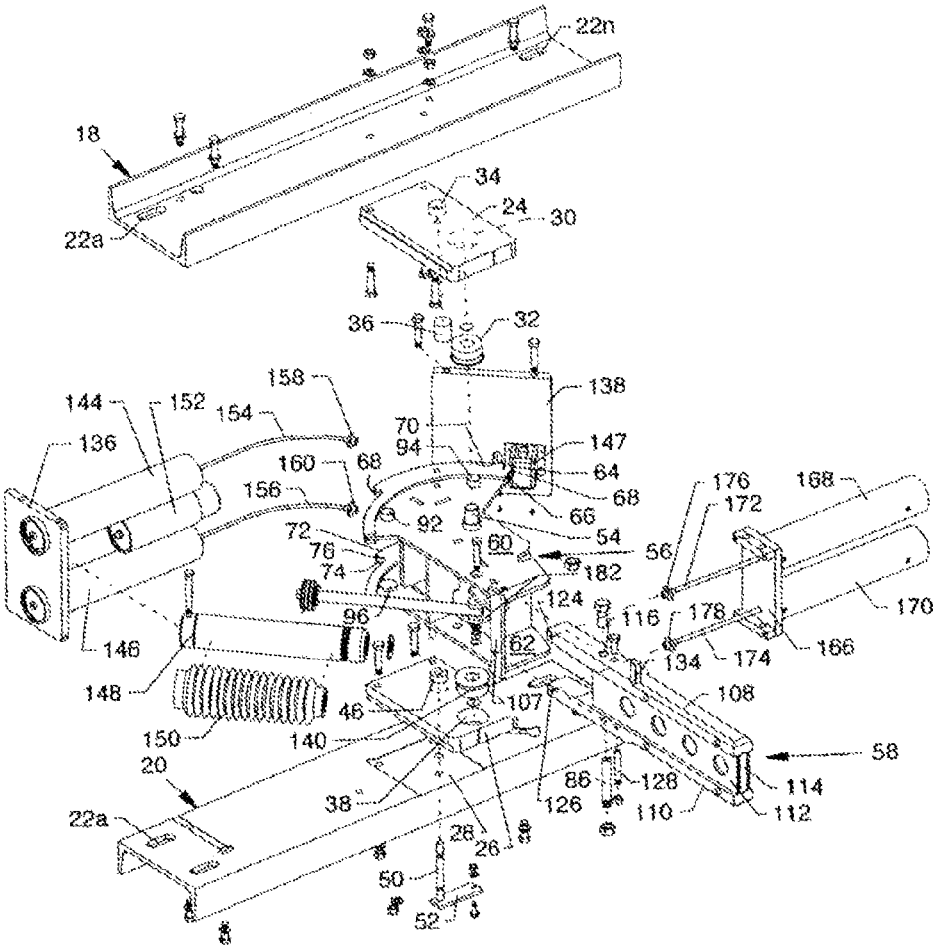
FIG. 6 is an exploded isometric view of the components of the invention shown in FIG. 5.

Multiple views of the invention are included for a full understanding of the present invention including isometric views, exploded isometric views, and isometric views of several components generally shown in a horizontal orientation as deployed across a crossing grade. FIG. 3 is a right side isometric view of the multiple direction railroad gate release mechanism 10 with a top bracket 18 (FIG. 2) removed for the purpose of clarity. FIG. 4 is an exploded isometric view of the components of the invention shown in FIG. 2. FIG. 5 is left side isometric view of the multiple direction railroad gate release mechanism to 10. FIG. 6 is an exploded isometric view of the components of the invention shown in FIG. 5. With respect to the above figures, the invention is further described. In the invention, a plurality of nuts, bolts, and lock washers are secured through a plurality of holes in a plurality of diverse components as is common practice in the art and as are shown or indicated in engagement or alignment wherever practicable or suitable in the accompanying illustrated figures.

Partial or fully visible components of the multiple direction railroad gate release mechanism 10 include opposing top and bottom mounting brackets 18 and 20 in the form of a channel, each having a plurality of mounting holes 22*a*-22*n* used in the attachment of mount arms 16*a* and 16*b* of the railroad gate actuator 12, as well as other holes and features for mounting other components thereto. Opposed top and bottom bearing support plates 24 and 26 are preferably aligned with recessed surfaces on the inwardly facing surfaces of the top and bottom mounting brackets 18 and 20 are suitably secured thereto; one such recessed surface 28 is shown in FIG. 4. The top bearing support plate 24 includes a circular recess 30 opening downwardly for the fixed accommodation of a top bearing assembly 32. The top bearing support plate 24 also includes a hole 34 for the fixed accommodation of a stop pin 36 having of a greater vertical dimension than the thickness dimension of the top bearing support plate 24. The bottom portion of such a top stop pin 36 extends downwardly a short distance beyond the bottom surface of the top bearing support plate 24. Also, the bottom bearing support plate 26 includes a circular recess 38 opening upwardly for the fixed accommodation of a bottom bearing assembly 40. The bottom bearing support plate 26 also includes a hole 44 for the protected accommodation of a bottom stop pin 46 having of a greater vertical dimension than the thickness dimension of the bottom bearing support plate 26. The top portion of such a bottom stop pin 46 extends upwardly a short distance beyond the top surface of the bottom bearing support plate 26. The bottom stop pin 46 includes a vertically aligned central bore 48, thus enabling the accommodation of a replaceable protective shear pin 50, the latter of which extends vertically and upwardly through the bottom mounting bracket 20. The protective shear pin 50 extends further to align coaxially and indirectly through the hole 44 and coaxially and directly into the central bore 48 of the bottom stop pin 46. The top portion of the replaceable shear pin 50 extends upwardly beyond the top surface of the bottom stop pin 46 to engage a hole 51 in a bottom swing plate 62. The replaceable shear pin 50 is secured to the bottom of the bottom mounting plate 20 by means of a moveable retainer plate 52. A connection between the top bearing support plate 24 and the bottom bearing support plate 26 is provided by a vertically oriented pivot pin 54 extending therebetween. Opposed ends of the vertically oriented pivot pin 54 are aligned within and extend between the top bearing assembly 32 and the bottom bearing assembly 40 and functions as support for a primary pivot arm assembly 56 described later in detail. A secondary pivot arm assembly 58 is pivotally supported by and extends outwardly from the primary pivot arm assembly 56. The pivot pin 54 extends through and is secured to the structure of the primary pivot arm assembly 56.

Figure 7:
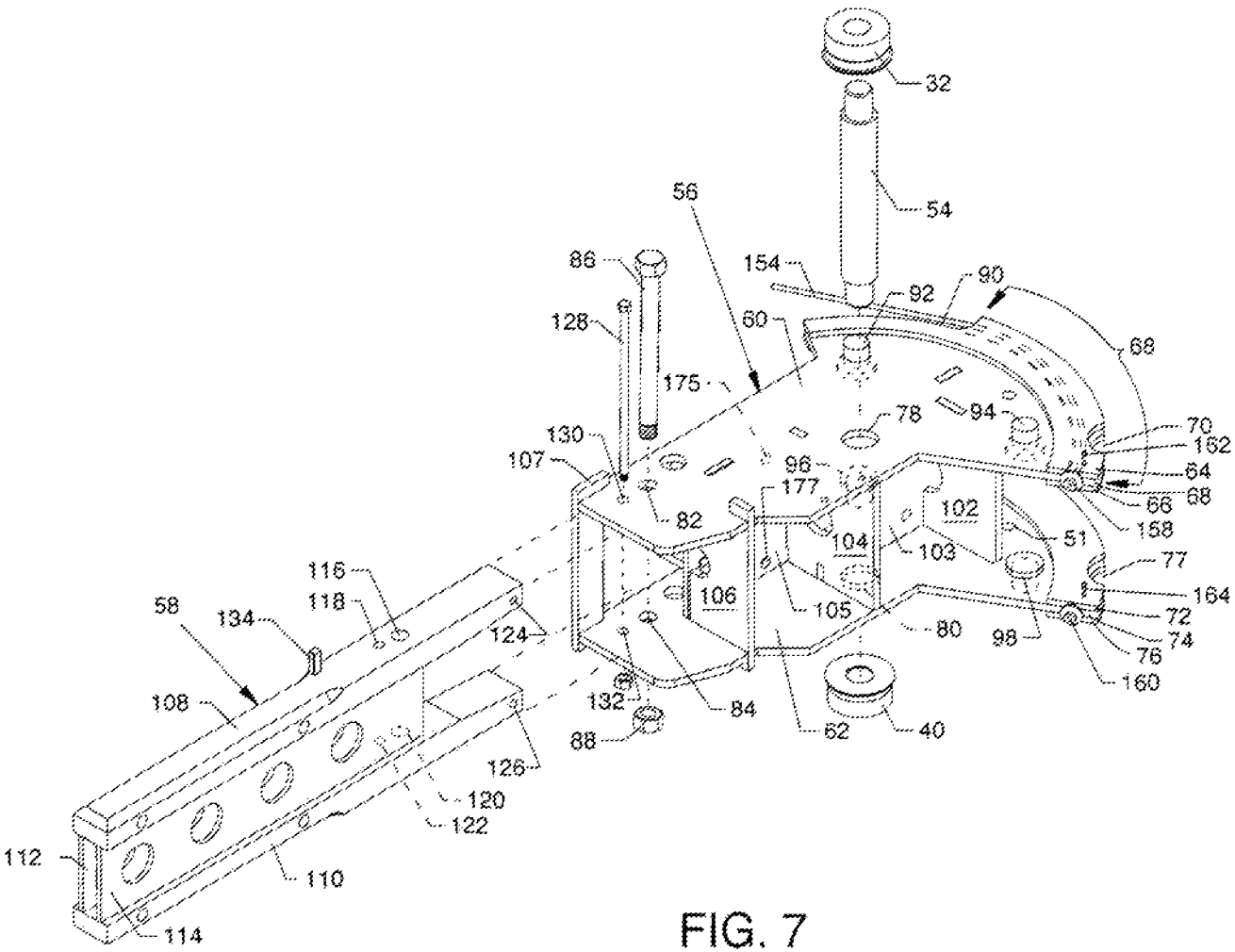
FIG. 7 is an isometric view of the primary and secondary arm assemblies and other closely associated components.

The primary pivot arm assembly 56 is aligned between the top and bottom bearing support plates 24 and 26, respectively, and is mounted and pivotally secured therebetween by the pivot pin 54 which is in close intimate contact with the top bearing assembly 32 and the bottom bearing assembly 40. The primary pivot arm assembly 56 includes, in part, opposing geometrically configured and vertically spaced top and a bottom swing plates 60 and 62. As viewed in FIG. 7, one end of the top swing plate 60 is arcuate in shape and accommodates the secured mounting of opposed arcuate top and bottom cable guide plates 64 and 66. The top and bottom cable guide plates 64 and 66 extend beyond the edge of the arcuate end of the top swing plate 60 to form an arcuate cable channel 68 therebetween. A semicircular detent 70 is formed by semicircular cutouts in each of the top and bottom cable guide plates 64 and 66, the combination of which forms the detent 70. The bottom swing plate 62 is made substantially similar to the top swing plate 60 and includes opposing arcuate top and bottom cable guide plates 72 and 74 to form an arcuate cable channel 76. A semicircular detent 77 is formed by semicircular cutouts in each of the top and bottom cable guide plates 72 and 74, the combination of which forms the detent 77. It is noted that the cable channel 68 and the cable channel 76 are abbreviated with respect to the full arcuate length of the top cable guide plate 64, the bottom cable guide plate 66, the top cable guide plate 72, and the bottom cable guide plate 74, respectively, in order to allow room for accommodation of spring assembly structures described later in detail. Such abbreviation is provided by reducing the width, i.e, a reduction of the radius of the top cable guide plate 64, the bottom cable guide plate 66, the top cable guide plate 72 and the bottom cable guide plate 74, such as representatively shown at reference 90 at the top cable guide plate 64. A hole 78 (FIG. 7) is included at the pivot axis of the primary pivot arm assembly 56 in the top swing plate 60 in opposed alignment with a hole 80 in the bottom swing plate 62 for accommodating of the opposed ends of the pivot pin 54. The body of the pivot pin 54 is suitably secured in the holes 78 and 80 such as by weldments. The ends of the pivot pin 54 extend beyond the top and bottom surfaces of the top swing plate 60 and the bottom swing plate 62 in order to fittingly accommodate the top bearing assembly 32 and the bottom bearing assembly 40, respectively. Another set of opposed holes is located at one end of the primary pivot arm assembly 56 including a hole 82 in the top swing plate 60 in opposed alignment with a hole 84 in the bottom swing plate 62 for accommodation of a pivot pin 86 in the form of a bolt which is secured therein by a nut 88. The pivot pin 86 is used to pivotally secure the secondary pivot arm assembly 58 to the primary pivot arm assembly 56 using holes 82 and 84 and pivot holes 116 and 120, each of which is shown in FIG. 7. Swing stops 92 and 94 are mounted in the top swing plate 60 and swing stops 96 and 98 are mounted in the bottom swing plate 62 in order to limit rotation of the primary pivot arm assembly 56 at clockwise and counterclockwise limits, as described below. Each swing stop is shouldered and protrudes through holes in the respective top or bottom swing plate 60 and 62. The swing stops 92 and 94 protrude upwardly through and slightly beyond the top surface of the top swing plate 60 in order to impinge the top stop pin 36 mounted in and extending downwardly from the top bearing support plate 24. The swing stops 96 and 98 protrude downwardly through and slightly beyond the bottom surface of the bottom swing plate 62 in order to impinge the bottom stop pin 46 extending from the bottom bearing support plate 26. Swing stops 92 and 96 provide a clockwise rotation stop at approximately 45° from center, for example, and the swing stops 94 and 98 provide a counterclockwise rotation stop at approximately 15° from center, for example and illustration. Vertically aligned tabbed brace plates 102, 103, 104, 105 and 106 are aligned and secured between the top swing plate 60 and the bottom swing plate 62, thereby connecting the top swing plate 60 and the bottom swing plate 62. A vertically oriented support plate 107 connects one edge of the top swing plate 60 to a corresponding edge of the bottom swing plate 62. The secondary pivot arm assembly 58 includes opposed horizontally aligned top and bottom bars 108 and 110, respectively. Opposed vertically aligned and spaced plates 112 and 114 are aligned and secured between the top and bottom bars 108 and 110. The top bar 108 includes a vertically aligned pivot hole 116 and a juxtaposed vertically aligned hole 118, each extending through the top bar 108. Correspondingly, the bottom bar 110 includes a vertically aligned pivot hole 120 and a juxtaposed vertically aligned hole 122, each extending through the bottom bar 110 in alignment with the pivot hole 116 and the hole 118 of the top bar 108. The inboard ends of the top bar 108 and the bottom bar 110 are aligned between the outboard ends of the top swing plate 60 and the bottom swing plate 62 and are pivotally connected to the pivot pin 86. The pivot pin 86 extends through holes 82 and 84 of the top swing plate 60 and the bottom swing plate 62 and through the holes 116 and 120 of the top and bottom bars 108 and 110, respectively. Horizontally aligned cable adapter holes 124 and 126 extend through the inboard ends of the top and bottom bars 108 and 110, respectively. A replaceable shear pin 128 which generally prevents pivoting of the secondary pivot arm assembly 58 with respect to the primary pivot arm assembly 56, is installed in holes 130 and 132, respectively, at the end of the top swing plate 60 and the bottom swing plate 62 and through holes 118 and 122 in the top and bottom bars 108 and 110. A stop bar 134 is located on the top bar 108 of the secondary pivot arm assembly 58 which is used to align the inboard end of the crossing arm 14 along the secondary pivot arm assembly 58.

Having described the structure of a plurality of components comprising the primary pivot arm assembly 56 and the secondary pivot arm assembly 58, and parts and components closely associated therewith thereto, other components and associated structure, which influence the static and the actuated states before, during, and after impingement of a crossing arm 14 by an outside force either to the front or to the rear of a crossing arm 14, are now described referring primarily to FIGS. 3, 4, 5 and 6. A vertically aligned left brace plate 136 and right brace plate 138 are mounted vertically between the top mounting bracket 18 and the bottom mounting bracket 20 such that the left brace plate 136 and right brace plate 138 serve as mounts for other components, as well as assisting in structural support for various previously described components.

Certain components are useful in maintaining position of as well as protecting and returning a displaced crossing arm 14 to a centered neutral position following the impingement on the front of the crossing arm 14 by an outside force. A plunger housing 140, including a spring loaded movable round end plunger 142, is mounted on the right brace plate 138. The round end plunger 142 extends through an opening in the right brace plate 138 in order to engage the detent 77 in the bottom swing plate 62 of the primary pivot arm assembly 56 and to maintain the position of the primary pivot arm assembly 56 in a static and centered neutral position, whereby the crossing arm 14 is maintained in an extended horizontal position across a grade crossing. Upon a forcible impingement on the front side of the crossing arm 14, the primary pivot arm assembly 56 is forced to rotate about the pivot pin 54 and simultaneously the top of the shear pin 50 is sheared whereby such movement drives the round end plunger 142 from the detent 77. Subsequent to disengagement of the round end plunger 142 from the detent 77, other forces, as provided by the operation of other components of the invention, serve to return the primary pivot arm assembly 56 to a static and centered neutral position, whereby the round end plunger 142 forcibly re-engages the detent 77. A collection of return components is associated directly or indirectly with the left brace plate 136 including pivotally mounted top and bottom spring assemblies 144 and 146, a shock absorber 148 having a cover 150 pivotally secured to the left brace plate 136 and a centering spring assembly 152 secured between the free ends of the top and bottom spring assemblies 144 and 146. Cables 154 and 156 extend from the top and bottom spring assemblies 144 and 146 to engage the length of the cable channels 68 and 76, respectively. Cable ball and washer assemblies 158 and 160 are affixed to the ends of the cables 154 and 156, respectively, and are aligned at one end of the cable channels 68 and 76, respectively. The ends of the cables 154 and 156 are positionally secured in the cable channels 68 and 76 by pins 162 and 164 (FIG. 7) extending through the top cable guide plate 64 and the bottom cable guide plate 66 and extending through the top cable guide plate 72 and the bottom cable guide plate 74, respectively, at a position outboard of and in close proximity to the cables 154 and 156. A connector assembly 145 connects between the round end plunger 142 support structure and an event counter 147 which is attached to the inside surface of the right brace plate 138.

Certain components are useful in protecting and returning a displaced crossing arm 14 to a centered neutral position with respect to impingement of the rear of the crossing arm 14 by an outside force. A vertically aligned bracket assembly 166 is secured to the edges of the top swing plate 60 and the bottom swing plate 62 of the primary pivot arm assembly 56 as a mount for a top and bottom spring assembly 168 and 170. The top and bottom spring assemblies 168 and 170 are suitably secured in armular grooves 171 and 173 in the bracket assembly 166. The ends of cables 172 and 174 (FIG. 4) extend from the top and bottom spring assemblies 168 and 170 through body holes 175 and 177 in the tabbed brace plate 105 (FIG. 7) and engage the cable connection holes 124 and 126 at the inboard ends of the top bar 108 and the bottom bar 110 of the secondary pivot arm assembly 58, respectively. Cable ball and washer assemblies 176 and 178 are affixed to the ends of cables 172 and 174, respectively, in order to retain the ends of the cables 172 and 174 within the cable connection holes 124 and 126, respectively.

Figure 8:
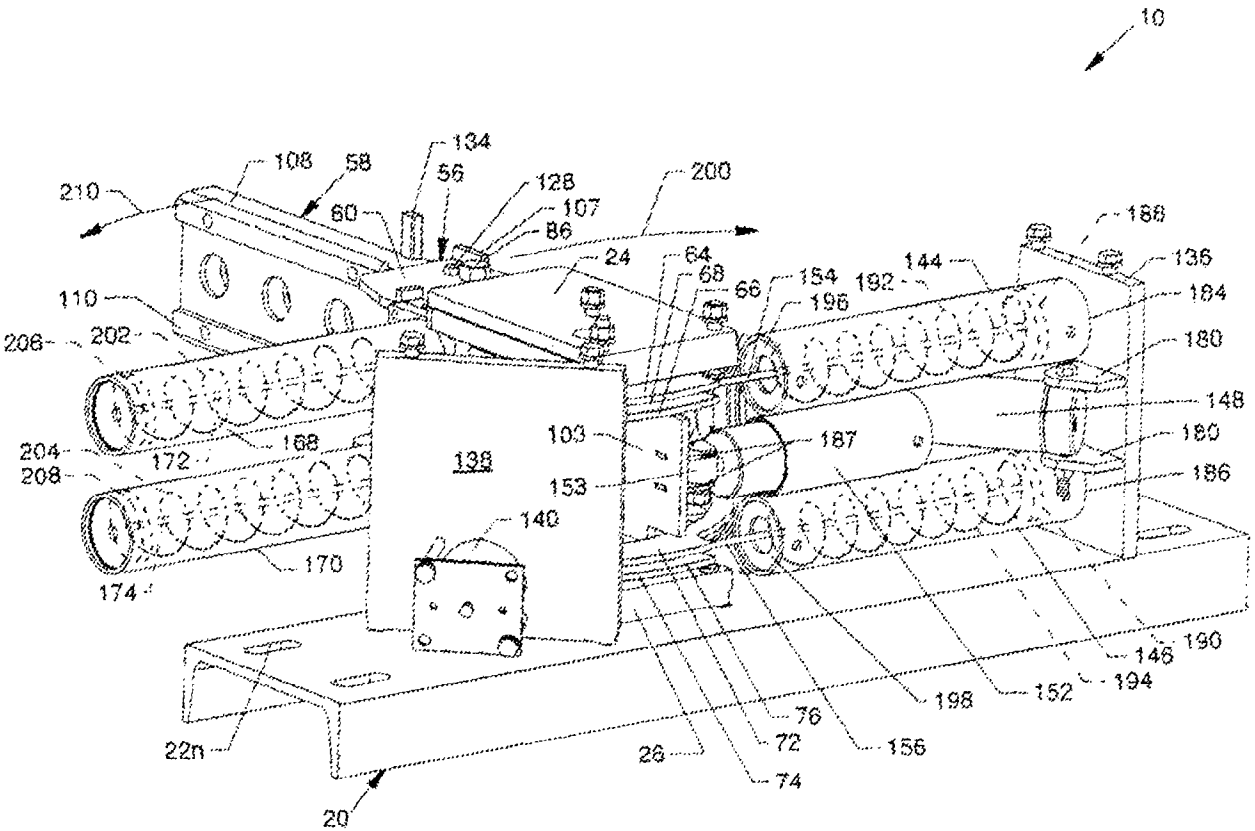
FIG. 8 is a rear isometric view of the multiple direction railroad gate release mechanism.

FIG. 8 is a rear isometric view of the elements shown in FIG. 3. Illustrated, in particular, is the relationship of the primary pivot arm assembly 56 with respect to the top and bottom spring assemblies 144 and 146, the centering spring assembly 152, and the shock absorber 148. Similar spaced mounting brackets 180 are secured to the left brace plate 136. One end of the shock absorber 148 is pivotally secured to the mounting brackets 180 and the other end of the shock absorber 148 is pivotally secured to spaced mounting brackets 182 on the rear of the tabbed brace plate 105 of the primary pivot arm assembly 56, as shown in FIG. 5. The shock absorber 148 when moved to a compressed position allows for the rapid rotational movement of the primary pivot arm assembly 56 from and beyond the neutral detent position during impingement of the front side of the crossing arm 14. The shock absorber 148 allows for a slower rate of movement when returning to the centered neutral position to suitably control the return rate of the primary pivot arm assembly 56 subsequent to impingement of the front side of the crossing arm 14. The body of the centering spring assembly 152 is secured, as previously described, between the outboard ends of the top and bottom spring assemblies 144 and 146. The free end of the centering spring assembly 152 closely juxtaposes a roller 153 mounted to the tabbed brace plate 103 by the use of spaced mounting brackets 187. The centering spring assembly 152 is used to urge and assist the primary pivot arm assembly 56 to return to a normal and detent position if a return over shoot occurs, as described later in detail. The horizontally oriented top and bottom spring assemblies 144 and 146 are aligned and suitably secured in bores 184 and 186 in the left brace plate 136. One end of cables 154 and 156 is secured by cable ball and washer assemblies 158 and 160 (FIG. 4), as previously described. The cables 154 and 156 are aligned in the cable channels 68 and 76 of the top and bottom swing plates 60 and 62, respectively. The other ends of the cables 154 and 156 are secured to circular plates 188 and 190 located inside of the top and bottom spring assemblies 144 and 146. Springs 192 and 194 are located interior to the top and bottom spring assemblies 144 and 146 between the circular plates 188 and 190 and the inward facing ends 196 and 198 of the top and bottom spring assemblies 144 and 146. Clockwise pivotal movement of the primary pivot arm assembly 56 about the pivot pin 54 also carries the attached secondary pivot arm assembly 58 in a clockwise direction as indicated by arrow 200 in a unitary clockwise movement. Such pivotal movement causes compression of the springs 192 and 194 to provide a built-up energy for subsequent spring powered action of the primary pivot arm assembly 56 (and the attached non-pivoted secondary pivot arm assembly 58) to return the primary pivot arm assembly 56 to its normal centered neutral detent position subsequent to frontal impingement of the crossing arm 14.

As partially shown in FIG. 8 and with understood reference to previously described figures, the relationship of the secondary pivot arm assembly 58 to the top and bottom spring assemblies 168 and 170 is now described. Springs 202 and 204 are located interior to the top and bottom spring assemblies 168 and 170 and are attached to and located between each of the circular plates 206 and 208 and the inward facing ends (not shown) of the top and bottom spring assemblies 168 and 170. Pivotal movement of the secondary pivot arm assembly 58 in a counterclockwise direction about the pivot pin 86 as indicated by arrow 210 is caused by impingement to the rear of the crossing arm 14 resulting in shearing of the shear pin 128 and in compression of the springs 202 and 204 through the cables 172 and 174. Such pivotal movement provides built-up energy for subsequent spring powered action by the top and bottom spring assemblies 168 and 170 to cause the secondary pivot arm assembly 58 to return to its normal position against the tabbed brace plate 105 subsequent to rearward impingement of the crossing arm 14.

Figure 9:
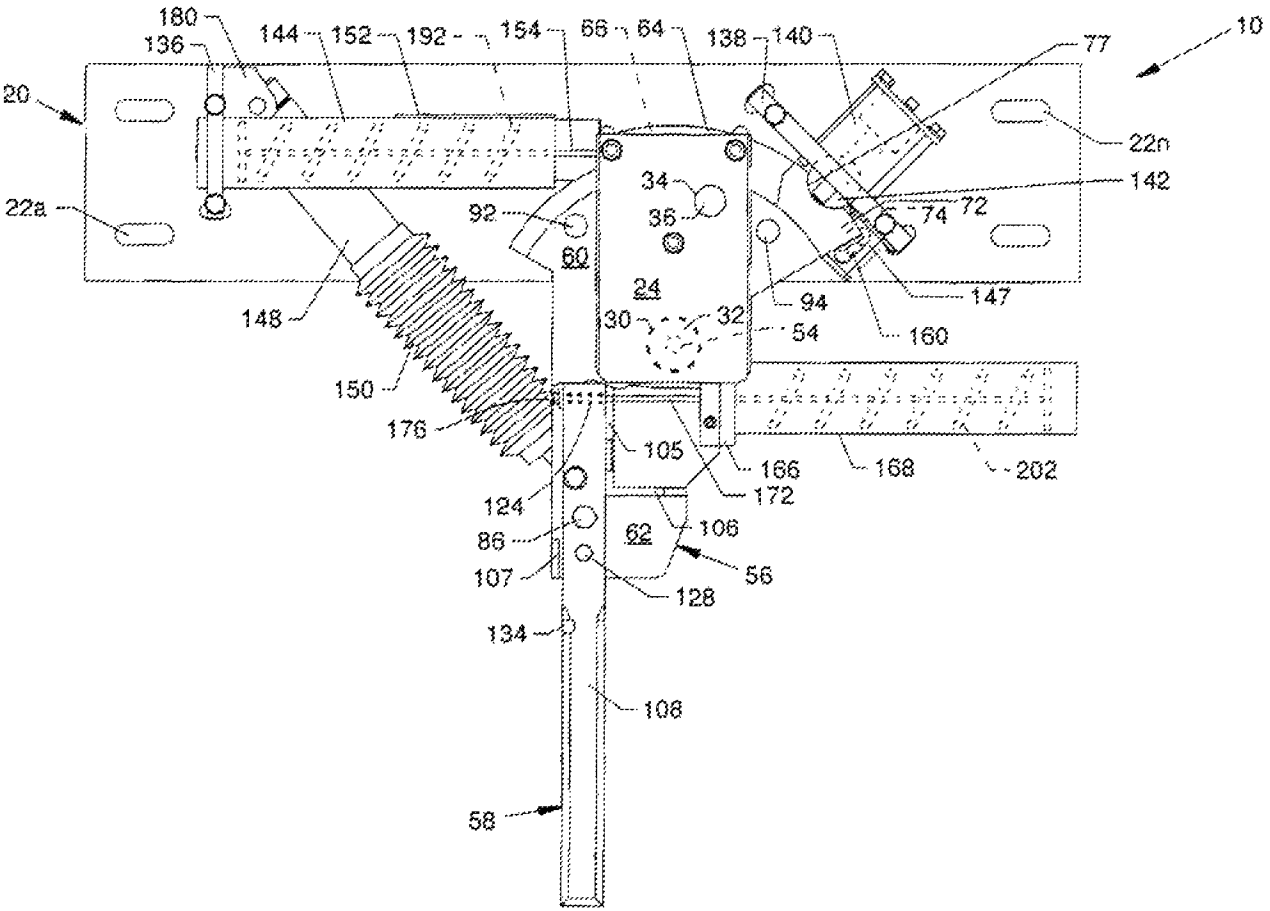
FIG. 9 is a top view of the multiple direction railroad gate release mechanism in partial cutaway showing its normal detent position when in use to deploy an attached crossing arm attached thereto.

FIG. 9 is a top view of the multiple direction railroad gate release mechanism 10 in partial cutaway showing its normal detent centered neutral position when in use to deploy in attached crossing arm 14 (not shown) across a railroad grade crossing. The top cable guide plate 64 and underlying bottom cable guide plate 66 are shown in partial cutaway to reveal the detent 77 of the primary pivot arm assembly 56. The portion of the top swing plate 60 located outboard of the tabbed brace plate 104 is cutaway in order to reveal and/or demonstrate the connection of the cable 172 (and the cable 174, not shown) to the inboard ends of the top bar 108 and the bottom bar 110 (not shown) of the secondary pivot arm assembly 58. The spring loaded round end plunger 142 forcibly and intimately engages the detent 77 of the primary pivot arm assembly 56 to maintain the neutral position of the primary pivot arm assembly 56 when the crossing arm 12 (FIG. 2) is extended across a railroad crossing grade. The spring loaded round end plunger 142 has a sufficient outwardly directed force to maintain the primary pivot arm assembly 56 including the secondary pivot arm assembly 58 and the attached crossing arm 14 in the desired centered neutral detent orientation in either a raised or lowered position or positions therebetween to maintain the desired proper orientation extending across the crossing grade unless impinged from either side by a vehicle or other outside force.

MODE OF OPERATION

Figure 10:
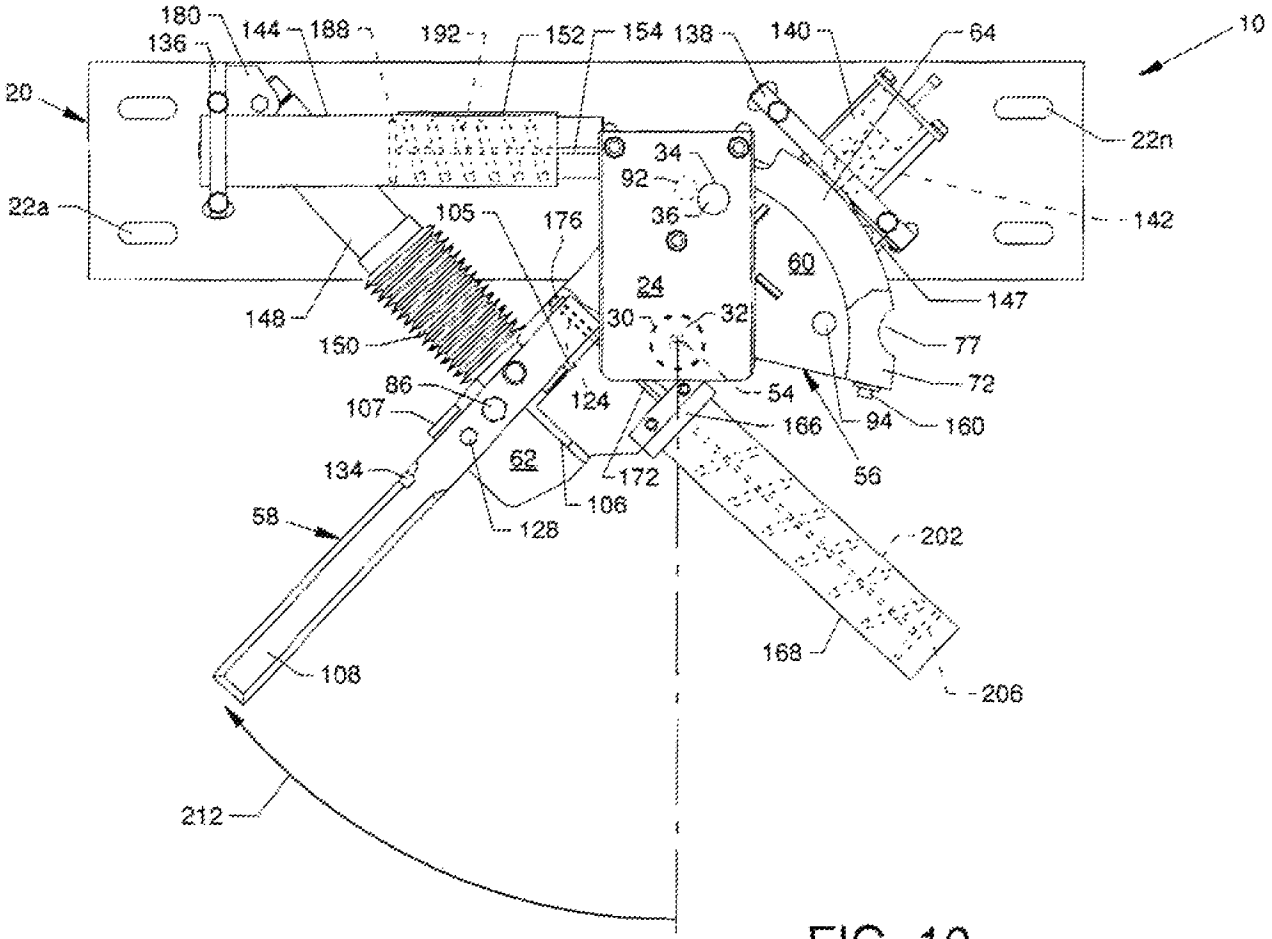
FIG. 10 is a top view of the multiple direction railroad gate release mechanism in partial cutaway illustrating the mode of operation of the multiple direction railroad gate release mechanism when an attached crossing arm is forcibly impinged from the front side; and, FIG. 11 is a top view of the multiple direction railroad gate release mechanism in partial cutaway and best illustrates the mode of operation of the multiple direction railroad gate release mechanism when an attached crossing arm is forcibly impinged from the back side.

FIG. 10 is a top view of the multiple direction railroad gate release mechanism 10 in partial cutaway, as described in FIG. 9, and best illustrates the mode of operation of the multiple direction railroad gate release mechanism 10 when an attached crossing arm 14 (not shown) is forcibly impinged from the front side. Impingement of the front side of the attached crossing arm 14 by a vehicle or other object forces causes pivoting of the primary pivot arm assembly 56 in a clockwise direction, as viewed from the top, about the pivot pin 54 as shown by arrow 212. Such forced pivoting causes a shearing of the top of the shear pin 50 and also causes forced disengagement of the spring loaded round end plunger 142 from the detent 77, whereby the round end plunger 142 tangentially and slidingly contacts the major portion of the outer edge of the arcuate top and bottom cable guide plates 72 and 74, respectively, of the primary pivot arm assembly 56, thus allowing the primary pivot arm assembly 56 and attached secondary pivot arm assembly 58 to pivot unitarily, thereby preserving the integrity of the attached crossing arm 14. During such forced unitary pivoting about the pivot pin 54, the angular relationship of the primary pivot arm assembly 56 and attached secondary pivot arm assembly 58 is unchanged with respect to each other. Clockwise pivoting of the primary pivot arm assembly 56 and attached secondary pivot arm assembly 58 is allowed at a suitable and rapid rate and is not significantly influenced by the shock absorber 148 in order that the crossing arm 14 can be rapidly deployed without breakage. However, return of the primary pivot arm assembly 56 and attached secondary pivot arm assembly 58 to the centered neutral detent position is influenced by the shock absorber 148 which acts to allow counterclockwise return pivoting at a rate much less than that during impingement caused by the clockwise pivoting. During frontal impingement caused by the clockwise pivoting of the primary pivot arm assembly 56 and attached secondary pivot arm assembly 58, the spring 192 in the top spring assembly 144 and the spring 194 in the bottom spring assembly 146 (FIG. 8) are compressed by the movement of the cables 154 and 156, respectively, one end of which resides in and is secured in the cable channels 68 and 76 located at the ends of the top swing plate 60 and the bottom swing plate 62, respectively. Such spring compression provides a force to subsequently return the primary pivot arm assembly 56 and attached secondary pivot arm assembly 58 toward and into the centered neutral detent position at a controlled rate as provided by the shock absorber 148, as previously described. Clockwise rotation is limited by impingement of the swing stop 92 of the top swing plate 60 with the top stop pin 36 of the top bearing support plate 24 as shown and by a similar impingement of the swing stop 96 of the bottom swing plate 62 with the bottom stop pin 46 of the bottom bearing support plate 26 (FIG. 4). For purposes of example and demonstration, such clockwise rotation is provided at 45° but shall not be considered to be limiting to the scope of the invention. Such limitation prevents overstressing or breakage of the top and bottom cables 154 and 156 and associated components. In the case of an unintended counterclockwise return overshoot of the detent 77 beyond the spring loaded round end plunger 142, counterclockwise motion is limited to 15° (for purposes of example and demonstration) by impingement of the swing stop 94 of the top swing plate 60 with the top stop pin 36 of the top bearing support plate 24 and by like impingement of the swing stop 98 of the bottom swing plate 62 with the bottom stop pin 46 of the bottom bearing support plate 26 (FIG. 4) to prevent overstressing or breakage of the top and bottom cables 172 and 174. In addition the centering spring assembly 152 can contact the roller 153 to urge and assist the primary pivot arm assembly 56 to return to a normal and centered neutral detent position in the event of a return overshoot, preferably prior to stopping at 15°. Such counterclockwise overshoot protection features ensure that the round end plunger 142 will maintain contact with the minor portion of the outer edge of the arcuate top and bottom cable guide plates 72 and 74, respectively, of the primary pivot arm assembly 56. The counterclockwise overshoot protection prevents the round end plunger 142 from disassociating with the minor portion of the outer edge of the arcuate top and bottom cable guide plates 72 and 74 and extending, for example, into the region of the cable ball and washer assembly 160, whereby an overly directed round end plunger 142 could lock the primary pivot arm assembly 56 and attached secondary pivot arm assembly 58 in a position to one side of the neutral detent position. For purposes of example and demonstration such counterclockwise rotation is provided at a 15° angle but shall not be considered limiting to the scope of the invention.

Figure 11:
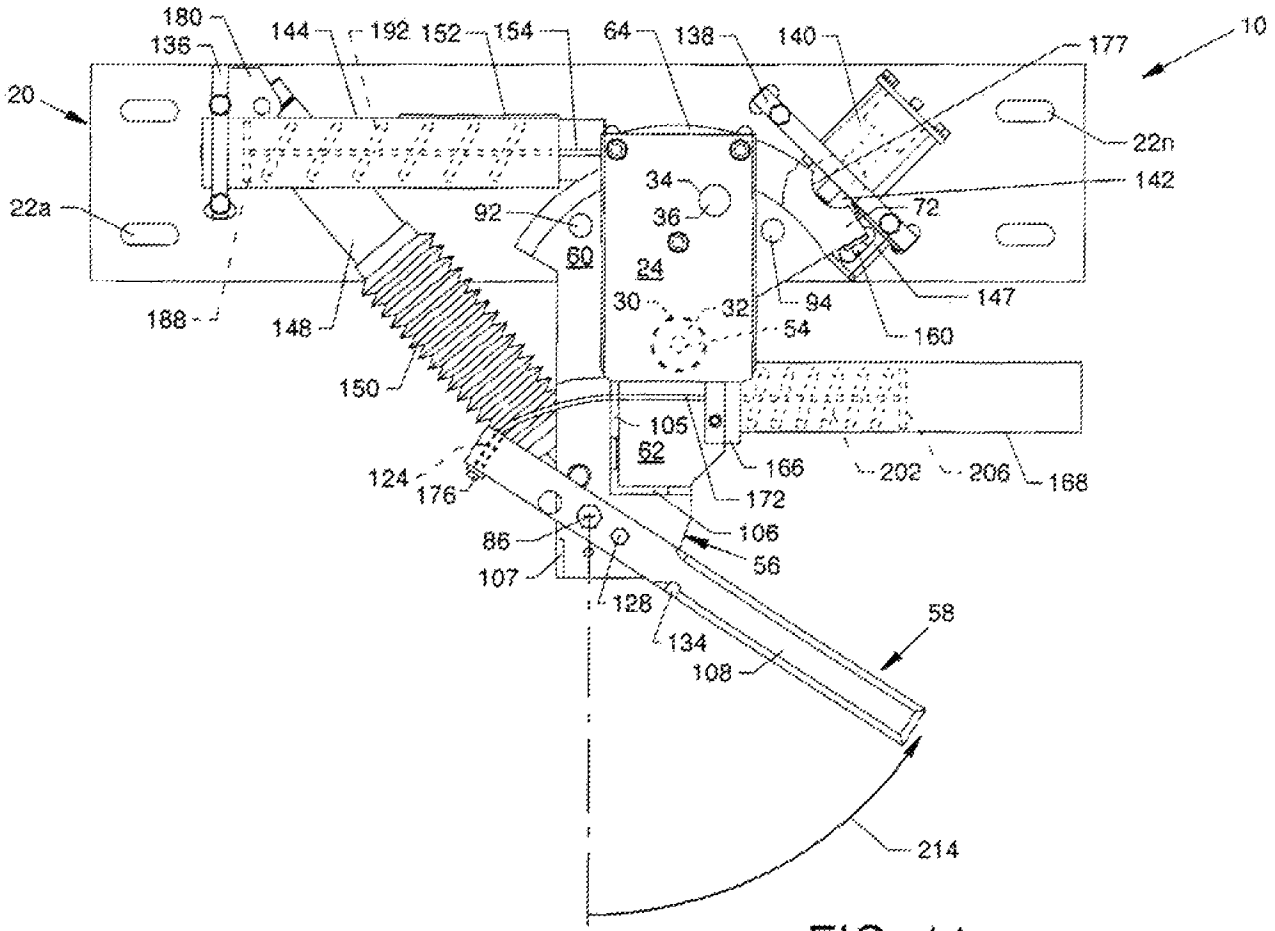

FIG. 11 is a top view of the multiple direction railroad gate release mechanism 10 in partial cutaway, as described in FIG. 9, and best illustrates the mode of operation of the multiple direction railroad gate release mechanism 10 when an attached crossing arm 14 (now shown) is forcibly impinged from the back side. Impingement of the back side of the attached crossing arm 12 by a vehicle or other substantial object causes shearing of the shear pin 128 and pivoting of the secondary pivot arm assembly 58 in a counterclockwise direction, as viewed from the top, about the pivot pin 86 as shown by arrow 214. During rearward impingement causing counterclockwise pivoting of the secondary pivot arm assembly 58, the spring 202 in the top spring assembly 168 and the spring 204 in the bottom spring assembly 170 (not shown) are compressed by the movement of the cables 172 and 174, respectively. Such a spring compression provides a force to subsequently return the secondary pivot arm assembly 58 in a clockwise rotation to intimately contact the tabbed brace plate 105 which is the normal position with respect to the primary pivot arm assembly 56. Counterclockwise rotation is limited by impingement of the top and bottom bars 108 and 110 with the tabbed brace plate 106 which functions as a stop to prevent overstressing or breakage of the top and bottom cables 172 and 174. Additionally, protection is provided in an articulating fashion. If the secondary pivot arm assembly 58 is positioned to invoke stoppage by the tabbed brace plate 106 and further positioned in a counterclockwise manner, additional protection is provided by counterclockwise rotation of the primary pivot arm assembly 56 until limitation by impingement of the swing stop 94 of the top swing plate 60 with the top stop pin 36 of the top bearing support plate 24 and by like impingement of the swing stop 98 of the bottom swing plate 62 with the bottom stop pin 46 of the bottom bearing support plate 26. Thus, pivotal arm relief is provided for either the front side or rear side impingement of the attached crossing arm 14. Shearing of the shear pin in a front impingement of the crossing arm 14 or shearing of the shear pin 128 is an indication to maintenance personnel that the crossing arm 14 has been impacted from the front or rear respectively. Crossing arm protection and function is in effect with the shear pins 50 or 128 in a sheared or un-sheared state.

Various modifications can be made to the present invention without departing from the apparent scope thereof.

PARTS LIST

10 multiple direction railroad gate release mechanism
12 railroad gate actuator
14 crossing arm
16*a-b* mount arms
18 top mounting bracket
20 bottom mounting bracket
22*a-n* mounting holes
24 top bearing support plate
26 bottom bearing support plate
28 recessed surface
30 circular recess
32 top bearing assembly
34 hole
36 top stop pin
38 circular recess
40 bottom bearing assembly
42 hole
44 hole
46 bottom stop pin
48 bore
50 shear pin
51 hole
52 retainer plate
54 pivot pin
56 primary pivot arm assembly
58 secondary pivot arm assembly
60 top swing plate
62 bottom swing plate
64 top cable guide plate
66 bottom cable guide plate
68 cable channel
70 detent
72 top cable guide plate
74 bottom cable guide plate
76 cable channel
77 detent
78 hole
80 hole
82 hole
84 hole
86 pivot pin
88 nut
90 reference
92 swing stop
94 swing stop
96 swing stop
98 swing stop
102 tabbed brace plate
103 tabbed brace plate
104 tabbed brace plate
105 tabbed brace plate
106 tabbed brace plate
107 support plate
108 top bar
110 bottom bar
112 plate
114 plate
116 pivot hole

118 hole
120 pivot hole
122 hole
124 cable connection hole
126 cable connection hole
128 shear pin
130 hole
132 hole
134 stop bar
136 left brace plate
138 right brace plate
140 plunger housing
142 round end plunger
144 top spring assembly
145 connector assembly
146 bottom spring assembly
147 event counter
148 shock absorber
150 cover
152 centering spring assembly
153 roller
154 cable
156 cable
158 cable ball and washer assembly
160 cable ball and washer assembly
162 pin
164 pin
166 bracket assembly
168 top spring assembly
170 bottom spring assembly
171 annular groove
172 cable
173 annular groove
174 cable
175 body hole
176 cable ball and washer assembly
177 body hole
178 cable ball and washer assembly
180 mounting brackets
182 mounting brackets
184 bore
186 bore
187 mounting bracket
188 circular plate
190 circular plate
192 spring
194 spring
196 end
198 end
200 arrow
202 spring
204 spring
206 circular plate
208 circular plate
210 arrow
212 arrow
214 arrow

What is claimed is:

1. An apparatus for releasing a railroad gate in at least two directions, comprising:

a primary pivot member; and a secondary pivot member pivotally connected to the primary pivot member, with one end of the railroad crossing connectable to the secondary pivot member, wherein the primary pivot member is rotable around a primary pivot of the apparatus, the primary pivot member rotable in a first direction against a first spring bias and in a second direction, opposite the first direction, against a second spring bias other than the first spring bias, and wherein the secondary pivot member is rotable around a secondary pivot of the apparatus, the secondary pivot member rotable in the first direction against a third spring bias other than the first spring bias and the second spring bias.

2. The apparatus of claim 1, wherein the primary pivot member includes a swing member having a distal end and a proximal end, with the primary pivot connected between the distal and proximal ends of the swing member, and with the secondary pivot connected to the proximal end of the swing member.

3. The apparatus of claim 2, wherein the secondary pivot member includes an elongated portion with a proximal end and a distal end, the secondary pivot connected to the elongated portion near the proximal end thereof with the railroad crossing member being fixedly attached to the distal end thereof.

4. The apparatus of claim 2, comprising a shock absorber coupled between a portion of the apparatus that supports the primary pivot the swing member, skew to an axis of the primary pivot.

5. The apparatus of claim 2, wherein the distal end of the swing member includes an arcuate section defining an arcuate channel sized to guide a cable therethrough, the arcuate channel having a proximal end and a distal end.

6. The apparatus of claim 5, comprising a first spring assembly having an elongated cylindrical housing with a proximal end and a distal end, the distal end of the cylindrical housing being fixed to a mounting bracket spaced from the proximal end of the arcuate channel, the housings having an elongated expanded spring therein and a circular plate therein, the spring having a proximal end and a distal end, the circular plate positioned at the distal end of the spring, the cylindrical housing having a circular plate with a central opening at the proximal end with the housing having an elongated cable extending therefrom, the elongated cable having a proximal end and a distal end, the proximal end of the elongated cable being fixed to the circular plate within the housing and extending through the cylindrical housing, through the central opening of the circular plate, through the proximal end of the arcuate channel, through a length of the arcuate channel, with a stopper fixed to a distal end of the cable being fixed to the distal end of the arcuate channel.

7. The apparatus of claim 6, comprising a second spring assembly, the second spring assembly having a second elongated cylindrical housing with a proximal end and a distal end, the proximal end of the second elongated cylindrical housing being fixed to a mounting bracket attached to a side of the primary pivot member between the proximal and distal ends of the primary pivot member, the elongated cylindrical housing of the second spring assemblies having an elongated expanded spring therein and a circular plate therein, the spring having a proximal end and a distal end, the circular plate being positioned at the distal end of the elongated expanded spring, the housing of the second spring assembly having an elongated cable extending therefrom, the elongated cable having a proximal end and a distal end, the proximal end of the elongated cable being fixed to the circular plate within the cylindrical housing and extending through the cylindrical housing, through a hole in the mounting bracket, through a cable connection hole in the secondary pivot member, the cable connection hole being spaced from the secondary pivot and a stopper at the distal end of the cable.

8. The apparatus of claim 6, comprising a centering spring assembly having a cylindrical housing, the cylindrical housing having an open proximal end and a closed distal end, the cylindrical housing being attached to the first spring assembly with a spring loaded cylinder slidable within the open proximal end and extending partially therefrom, the spring loaded cylinder having a closed end external to the cylindrical housing that is coupled to the swing member near the distal end of the primary pivot member.

9. The apparatus of claim 8, wherein the swing member has a semicircular cutout forming a detent with a plunger assembly coupled to dispose a round ended plunger into the defeat.

10. An apparatus for connection to a vertical post at a railroad crossing intersection, comprising:

a multiple direction railroad gate release mechanism, said gate release mechanism being attached to one end of a railroad crossing arm and supported by a pair of spaced mounting arms attached to a vertical post at a railroad crossing intersection, said gate release mechanism being supported between top and bottom spaced mounting brackets which are in turn supported by said pair of spaced mounting arms, said gate release mechanism comprising:

a primary pivot arm assembly pivotally connected between said top and bottom mounting brackets; and a secondary pivot arm assembly being pivotally connected to said primary pivot arm assembly, with one end of said railroad crossing arm fixedly connected to said secondary pivot arm assembly, wherein the primary pivot arm assembly is horizontally rotable around a primary pivot pin of the multiple direction railroad gate release mechanism, the primary pivot arm assembly horizontally rotable in a first direction against a first spring bias and in a second direction, opposite the second direction, against a second spring bias other than the first spring bias, and wherein the secondary pivot arm assembly is horizontally rotable around a secondary pivot pin of the multiple direction railroad gate release mechanism, the secondary pivot arm assembly rotable in the second direction against a third spring bias other than the first spring bias and the second spring bias.

11. The apparatus of claim 10, wherein the primary pivot arm assembly is supported by at least one bearing.

12. The apparatus of claim 11, wherein the bearing is part of a bearing plate assembly that includes a stop pin, and wherein a swing stop is coupled to a swing member that is part of the primary pivot arm assembly, the stop pin and the swing stop to limit pivotal movement of the primary pivot arm assembly.

13. The apparatus of claim 12, wherein the gate release mechanism further includes a primary shear pin disposed through a hole in the stop pin and outwardly through a hole in the swing member.

14. The apparatus of claim 13, comprising a secondary shear pin extending through a hole in the swing member, near the secondary pivot.

15. An apparatus for attachment to a support structure for pass and no-pass access across a given passageway, comprising:

a multiple gate release mechanism attached between one end of a horizontally disposed elongated crossing gate and the support structure, said elongated crossing gate mountable at a predetermined distance above ground level, said apparatus comprising:

a primary means for returnably rotating a horizontally disposed elongated crossing gate in a down position against a first bias around a pivot in a first direction, and for rotating in a second direction, against a second bias; and a secondary means for returnably rotating the horizontally disposed elongated crossing gate against a third bias around a further pivot in the second direction, wherein the secondary means is pivotally attached to said primary means and is fixedly attached to said horizontally disposed elongated crossing gate.

16. The apparatus of claim 15, wherein the primary means includes a first spring biased cable and pivot means for horizontally moving the elongated crossing gate in the first direction and wherein the secondary means includes a second spring biased cable and pivot means for horizontally moving the elongated crossing gate in the second direction.

17. The apparatus of claim 16, comprising a means for automatically returning the elongated crossing gate to a neutral position.

18. The apparatus of claim 17, wherein the means for automatically returning the elongated crossing gate to a neutral position includes the first spring biased cable and pivot means operatively associated with the primary means, the second spring biased cable and pivot means operatively associated with the secondary means, a shock absorber coupled to the primary means, and a plunger disposed against a detent of the primary means, the plunger to maintain the crossing gate in a neutral position.

19. The apparatus of claim 18, wherein the first bias is a spring assembly, the second bias is a spring assembly, and the third bias is a spring assembly.

20. The apparatus of claim 19, wherein a bias force of the third bias is weaker than a further bias force of the first bias.

* * * * *